US007377313B2

(12) United States Patent
Brown et al.

(10) Patent No.: US 7,377,313 B2
(45) Date of Patent: May 27, 2008

(54) GAS SEPARATOR FLUID CROSSOVER FOR WELL PUMP

(75) Inventors: Donn J. Brown, Broken Arrow, OK (US); Brown Lyle Wilson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 256 days.

(21) Appl. No.: 11/099,734

(22) Filed: Apr. 6, 2005

(65) Prior Publication Data

US 2005/0281683 A1 Dec. 22, 2005

(51) Int. Cl.
*E21B 43/38* (2006.01)

(52) U.S. Cl. ..... 166/105.5; 166/105.6

(58) Field of Classification Search ..... 417/313, 417/423.9, 424.1; 166/105.5, 105.6
See application file for complete search history.

(56) References Cited

U.S. PATENT DOCUMENTS

| | | | | |
|---|---|---|---|---|
| 5,207,810 | A | 5/1993 | Sheth | |
| 6,394,182 | B1 * | 5/2002 | Fadel | 166/265 |
| 6,705,402 | B2 * | 3/2004 | Proctor | 166/369 |

* cited by examiner

*Primary Examiner*—Jennifer H. Gay
*Assistant Examiner*—Brad Harcourt
(74) *Attorney, Agent, or Firm*—Bracewell & Giuliani LLP

(57) ABSTRACT

A submersible pump gas separator for a well pump has a housing with a rotatable shaft. A separating section in the housing separates heavier well fluid components into an area radially outward from the lighter components. A crossover member rotates with the shaft. The crossover member has a helical liquid passage having an inlet in fluid communication with the separating section for receiving the heavier components and an outlet in fluid communication with a liquid outlet of the housing. The crossover has a gas passage having an inlet in fluid communication with the separating section for receiving the lighter components and an outlet in fluid communication with a gas outlet of the housing.

19 Claims, 3 Drawing Sheets

Fig. 3
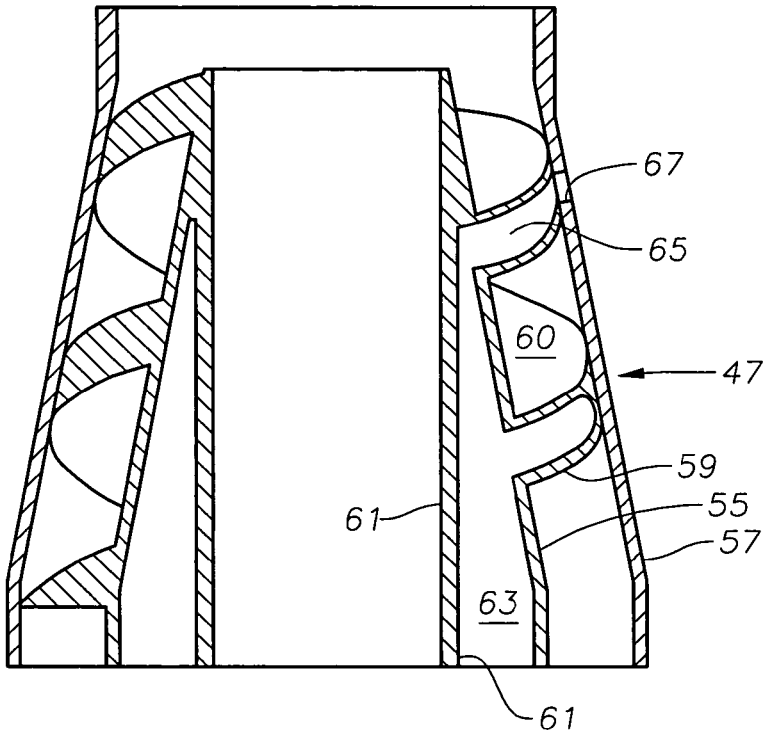
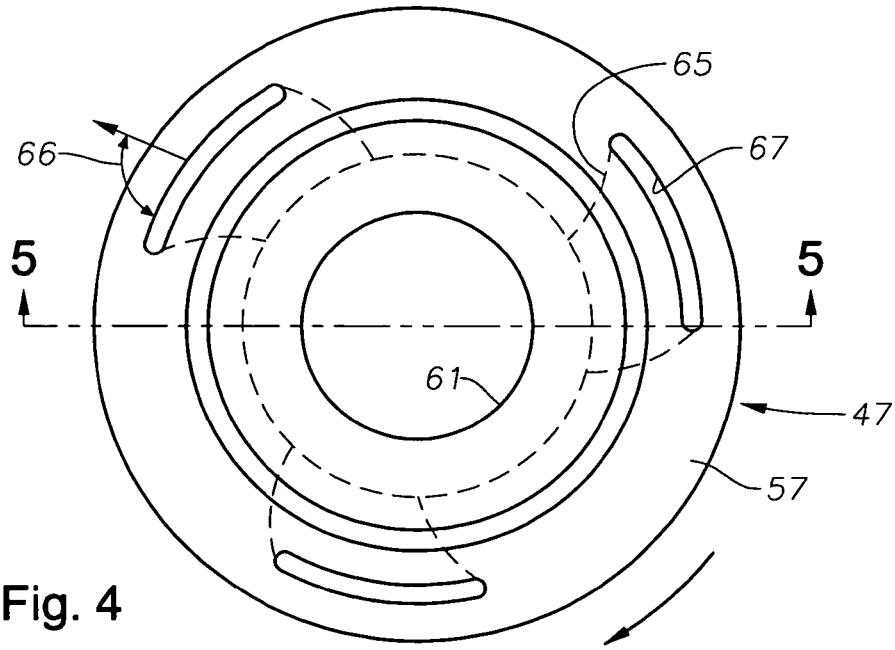
Fig. 4

GAS SEPARATOR FLUID CROSSOVER FOR WELL PUMP

FIELD OF THE INVENTION

This invention relates in general to electrical submersible pumps and in particular to a gas separator having a fluid crossover that rotates.

BACKGROUND OF THE INVENTION

A common type of well pump for petroleum production has a submersible centrifugal pump and an electrical motor. The pump has a plurality of stages, each stage having an impeller and a diffuser. The motor rotates a shaft extending through the pump, which causes the impellers to rotate to pump the well fluid up the well. Another type of well pump, called a progressive cavity pump, rotates a helical rotor within a stator having a double helical cavity. In both types of pumps, if the well fluid contains gas, the gas is detrimental to the pumping efficiency.

Down hole gas separators are commonly employed with down hole pumps to remove as much gas as feasible from the well fluid flowing into the intake of the pump. In standard down hole gas separators for centrifugal pumps, fluids are drawn into the intake of the separator and spun by way of various components that are intended to propel and separate the lighter gaseous well fluid components from the heavier liquid components. The heavier component is spun to the outer surface of the chamber while the lighter component remains in the central part of the chamber.

In prior art down hole separators, both fluids are propelled into a passive or static crossover. The crossover has a liquid passage that directs liquids back to the center and toward the inlet of the pump. The lighter components are direct back by gas passages toward the exterior of the gas separator for discharge into the casing annulus. Friction losses hinder the movement of the fluids through these passages and reduces the efficiency of the separation.

SUMMARY OF THE INVENTION

The gas separator of this invention has a crossover with a hub section that engages the shaft for rotating the crossover therewith. The crossover has a helical liquid passage having an inlet in fluid communication with the separating section of the gas separator for receiving the heavier components. The liquid passage has an outlet in fluid communication with the liquid outlet of the housing. The crossover has a gas passage having an inlet in fluid communication with the separating section for receiving the lighter components and an outlet in fluid communication with the gas outlet of the housing. Rotation of the crossover propels the liquid toward the pump, and propels the gas into the casing annulus.

Preferably, the outlet of the gas passage has an exit angle less than 90 degrees. Also, preferably, the liquid passage extends completely around the crossover at least one time. In the preferred embodiment, a radial distance from the liquid passage to the shaft decreases continuously from the inlet to the outlet of the liquid passage. The gas passage has a flow area that is greater at the inlet than the outlet of the gas passage in the example shown.

BRIEF DESCRIPTION OF THE DRAWINGS

FIG. 3 is an enlarged sectional view of the fluid crossover of the gas separator of FIG. 2A.

FIG. 4 is a top view of the fluid crossover of FIG. 3.

DESCRIPTION OF THE PREFERRED EMBODIMENT

Figure 1:
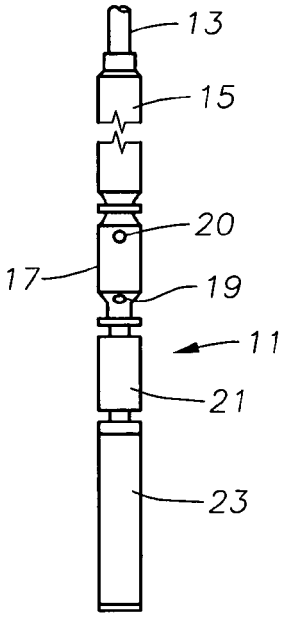
FIG. 1 is a side elevational view of an electrical submersible pump assembly constructed in accordance with this invention.

Referring to FIG. 1, an electrical submersible pump assembly 11 is suspended on a string of production tubing 13. Electrical submersible pump assembly 11 comprises a conventional pump 15, which is typically a centrifugal pump having a large number of stages, each stage having an impeller and a diffuser. A gas separator 17 connects to the intake end of pump 15 for separating gas from the well fluid entering pump 15. Gas separator 17 has an intake 19 for receiving well fluid and a plurality of discharge ports 20 for discharging gas to the annulus surrounding assembly 11.

A seal section 21 connects to the intake end of gas separator 17. An electrical motor 23 connects to the opposite end of seal section 21. Seal section 21 equalizes pressure of lubricant within motor 23 with that of the hydrostatic fluid surrounding motor 23.

Figure 2A:
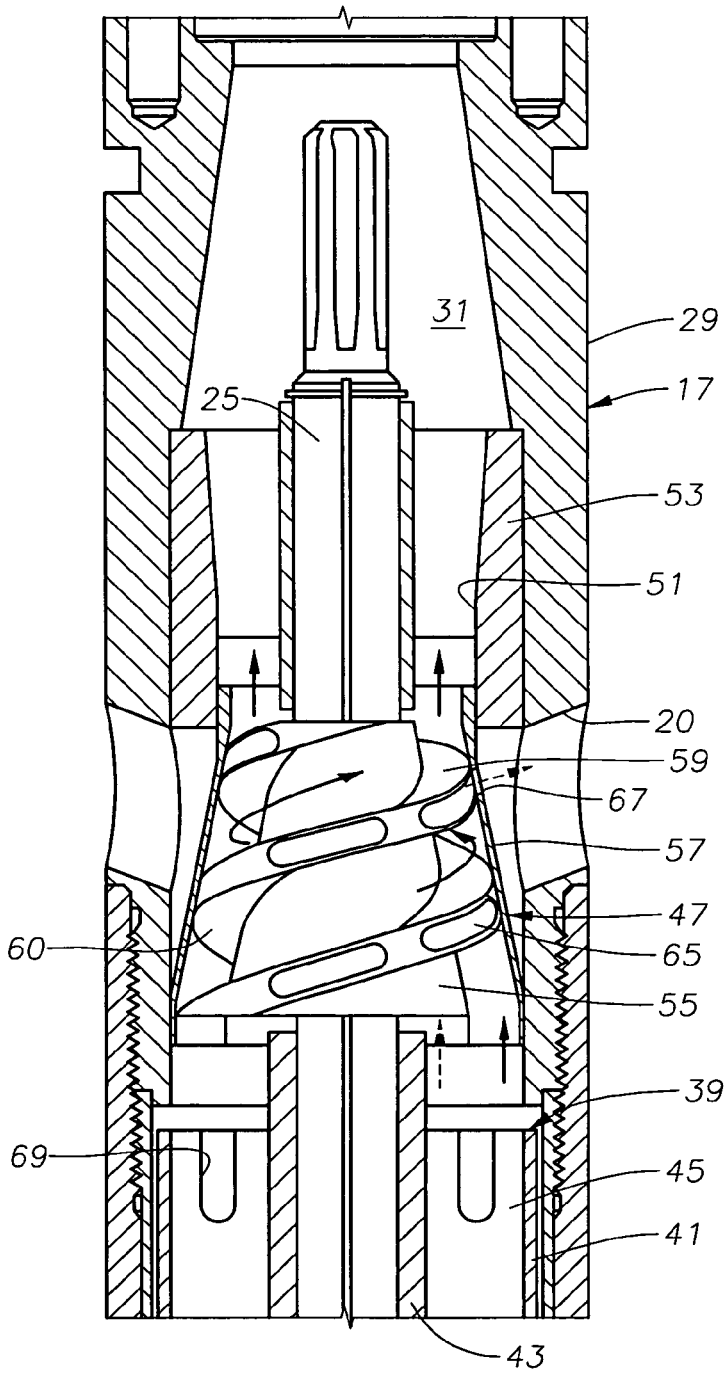
FIGS. 2A and 2B comprise an enlarged vertical sectional view of a portion of the gas separator of the pump assembly of FIG. 1.
Figure 2B:
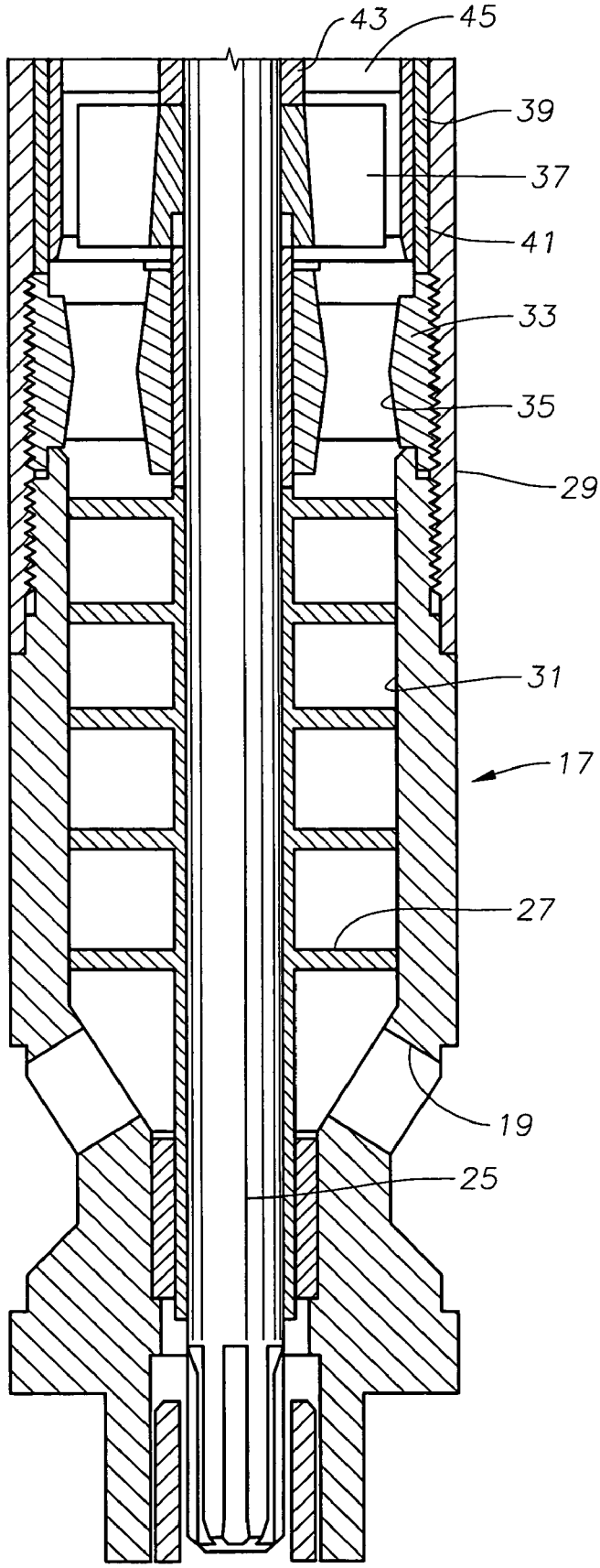

Referring to FIG. 2B, a drive shaft 25 extends through motor 23, seal section 21, gas separator 17 and pump 15. Gas separator 17 may be of a variety of types, including a vortex type or one that has a rotating rotor, as shown in FIG. 2B. In the example shown, gas separator 17 includes an optional inducer 27 to increase the pressure of the fluid flowing into intake 19. Inducer 27 comprises a helical flight that rotates with shaft 25 within stationary housing 29 of gas separator 17. The periphery of the helical flight of inducer 27 is closely spaced to bore 31 of housing 29.

Gas separator 17 optionally may have a bearing 33 located at the upper end of inducer 27. Bearing 33 is of a spider type, having a plurality of passages 35 extending through it for the passage of the well fluid. Bearing 33 is stationary and supports shaft 25 in bore 31 of gas separator housing 29. The well fluid flows from passages 35 to a set of rotating guide vanes 37 in this embodiment. Guide vanes 37 comprise a plurality of curved plates that are inclined relative to the axis of shaft 25 to impart a swirling motion to the well fluid. Guide vanes 37 rotate with shaft 25 and deliver the fluid to the separation section, which includes a separator rotor 39.

In this embodiment, rotor 39 has a rotating outer cylinder 41 that is closely spaced to the sidewall of bore 31 of housing 29. Outer cylinder 41 is supported by and rotates with a hub 43 that is keyed to shaft 25 for rotation therewith. Several rotor vanes 45 extend between outer cylinder 41 and hub 43. Preferably, rotor vanes 45 are located in radial planes that pass through the axis of shaft 25. Other types of separator rotors are also feasible. Rotor 39 causes centrifugal separation of the heavier well fluid components from the gas, resulting in the liquid components flowing up the inner diameter of cylinder 41. The gas components remain in the central area.

Referring to FIG. 2A, the separate liquid and gas streams flow to a fluid crossover 47, which rotates with shaft 25. Fluid crossover 47 directs the liquid components upward and radially inward and the gas components upward and radially outward. In this embodiment, the upper end of fluid crossover 47 extends to a bearing 53 having a plurality of passages 51. The liquid components flow from passages 51 into bore 31 at the upper end of gas separator 17, as shown by the solid arrows.

Crossover 47 has a central core 55, which preferably has a conical interior and exterior, each having a smaller diameter downstream end than its upper end. Core 55 is supported inside a shroud 57 for rotation therewith. Shroud 57 also has a conical interior and exterior, each having a larger diameter at its upstream end and a smaller diameter at its downstream end. An auger flight 59 extends helically between core 55 and shroud 57. Auger flight 59 extends completely around core 55 at least one turn, and in the example, extends two to three turns. Auger flight 59 has an inner edge that joins core 55 and an outer edge that joins shroud 57, defining a helical liquid passage 60 for the heavier liquid components, the flow of which is indicated by the solid arrows. The inlet to liquid passage 60 at the lower end of crossover 47 is located farther from shaft 25 than the outlet at the upper end of crossover 47.

Referring to FIG. 3, crossover 47 has a hub 61 that is keyed to shaft 25 (FIG. 2B) for rotation therewith. Hub 61 has a cylindrical exterior, defining a generally conical gas cavity 63 within core 55 between hub 61 and the conical interior surface of core 55. Core gas cavity 63 extends upward a selected distance within core 55 and has a decreasing outer diameter. Gas cavity 63 is annular, and the flow area of gas cavity 63 decreases in a downstream direction.

Auger flight 59 is sufficiently thick in an axial direction to accommodate several outlet passages 65, which are located between the upper and lower sides of auger flights 59. The axial thickness of auger flight 59 is thinner than the distance between turns of flight 59 in this embodiment. Passages 65 join gas cavity 63 and lead to the outer edges of auger flights 59. Several outlet ports 67 are formed in shroud 57, each joining the outer end of one of the passages 65. As shown in FIG. 4, outlet ports 67 are circumferentially elongated, with centers about 120 degrees apart from each other. Gas separator ports 20 are located within housing 29 radially outward from shroud outlet ports 67 for receiving gas being discharged from outlet ports 67. Preferably, passages 65 are curved and incline away from the direction of rotation, as illustrated by the arrow in FIG. 4. The inlet ends of passages 65 lead the outlet ends of passages 65. This curvature creates an exit angle 66 that is less than 90 degrees, which would be on a radial line. In the example shown, exit angle 66 is about 70 degrees, but it could vary.

Referring to FIG. 2A, rotor blades 45 may have notches 69 formed in their upper edges between hub 43 and cylinder 41. An annular skirt (not shown) may extend from crossover 47 downward into notches 69 to provide a physical barrier between the gas and liquid flowing from rotor 39 into crossover 47.

In operation, referring to FIG. 1, electrical power supplied to motor 23 causes motor 23 to rotate shaft 25 (FIGS. 2A, 2B) to drive separator rotor 39 and pump 15. Well fluid flows into gas separator intake 19. Referring to FIG. 2B, inducer 27 increases the pressure of the well fluid and delivers it to guide vane 37. Rotating guide vane 37 imparts swirling motion to the well fluid and delivers it to rotating rotor 39 (FIG. 2A). Rotor vanes 45 cause centrifugal separation of the liquid and gas components, with the liquid components flowing outward into contact with the outer cylinder 41 of rotor 39.

As shown in FIG. 2A, the liquid components flow into the helical passage 60 located between auger flights 59. The solid arrows indicate the liquid components being delivered up through bearing passage 51 and from gas separator bore 31 into the intake of pump 15 (FIG. 1).

The gas components, being located near hub 43, pass into gas cavity 63 as shown in FIG. 3. The decreasing flow area of cavity 63 and the outward inclined passages 65 accelerate the gas through shroud outlet ports 67, as indicated by the dashed lines in FIG. 2A. The gas flows out gas separator ports 20 into the casing annulus surrounding pump assembly 11.

The invention has significant advantages. The rotating crossover imparts energy to the liquid and gas streams to improve the efficiency of the separation. This additional energy reduces friction losses of the flowing streams.

While the invention has been shown in only one of its forms, it should be apparent to those skilled in the art that it is not so limited but is susceptible to various changes without departing from the scope of the invention.

The invention claimed is:

1. A submersible pump gas separator for a well pump, the separator having a housing with an inlet for receiving well fluid, a liquid outlet for delivering heavier components of the well fluid to a first destination, a gas outlet for discharging lighter components of the well fluid to a second destination, a rotatable shaft extending through the housing, a separating section in the housing for separating the heavier components into an area radially outward from the lighter components relative to the shaft, and a crossover for delivering the heavier components to the liquid outlet and the lighter components to the gas outlet, the crossover comprising:

a hub section that engages the shaft for rotating the crossover therewith;

a helical liquid passage having an inlet in fluid communication with the separating section for receiving the heavier components and an outlet in fluid communication with the liquid outlet of the housing; and a gas passage having an inlet in fluid communication with the separating section for receiving the lighter components and an outlet in fluid communication with the gas outlet of the housing.

2. The gas separator according to claim 1, wherein the inlet of the gas passage leads the outlet of the gas passage relative to the direction of rotation of the crossover.

3. The gas separator according to claim 1, wherein the liquid passage extends completely around the crossover at least one time.

4. The gas separator according to claim 1, wherein a radial distance from the liquid passage to the shaft decreases continuously from the inlet to the outlet of the liquid passage.

5. The gas separator according to claim 1, wherein the gas passage has a flow area that is greater at the inlet than the outlet of the gas passage.

6. The gas separator according to claim 1, wherein the gas passage has at least a section of decreasing flow area from the inlet toward the outlet of the gas passage.

7. The gas separator according to claim 1, wherein the outlet of the liquid passage is closer to the shaft than the inlet of the liquid passage.

8. The gas separator according to claim 1, wherein the inlet of the gas passage is closer to the shaft than the outlet of the gas passage.

9. A submersible pump gas separator for a well pump, comprising:

a tubular housing with an inlet for receiving well fluid;

a rotatably driven shaft extending through the housing;

a separating section in the housing that rotates with the shaft for separating heavier components of the well fluid into an area radially outward from lighter components of the well fluid;

an outlet port in the housing for discharging the lighter components from the housing;

a crossover member mounted to the shaft for rotation therewith, the crossover member comprising:

a core portion that has a generally conical exterior with a larger diameter at an upstream end and a smaller diameter at a downstream end;

a shroud surrounding the core portion and having a generally conical interior spaced from the conical exterior of the core portion;

an auger flight having an inner edge joining the core portion and an outer edge joining the shroud, defining a liquid passage between the core and the shroud for receiving the heavier components from the separating section and delivering the heavier components to the interior of the housing;

a gas passage having an inlet portion in the core and an outlet portion within the auger flight, the outlet portion extending from the inner edge to the outer edge of the auger flight; and an outlet port in the shroud that registers with the outlet portion of the gas passage and is in fluid communication with the outlet port in the housing for discharging the lighter components exterior of the housing.

10. The gas separator according to claim 9, wherein the auger flight extends at least one full turn around the core.

11. The gas separator according to claim 9, wherein:

the cross member further comprises a hub with a cylindrical bore for sliding over the shaft; and the hub has an exterior spaced from an interior of the core, defining the inlet portion of the gas passage.

12. The gas separator according to claim 11, wherein the exterior of the hub is cylindrical and the flow area of the inlet portion decreases in a downstream direction.

13. The gas separator according to claim 9, wherein the inlet portion of the gas passage is an annular cavity and the outlet portion of the gas passage comprises a plurality of outlet portions spaced circumferentially apart from each other.

14. The gas separator according to claim 9, wherein the outlet portion of the gas passage has an exit angle less than a 90 degree angle defined by a radial line emanating from a longitudinal axis of the shaft and passing through the outlet portion of the gas passage.

15. The gas separator according to claim 9, wherein the auger flight has an axial thickness that is less than an axial distance between turns of the flight.

16. A method of separating heavier components from lighter components of well fluid with a downhole well pump, comprising:

(a) providing a gas separator with a separating section and a crossover, the crossover having a helical liquid passage and a gas passage;

(b) connecting the gas separator to the pump;

(c) rotating the pump and the crossover;

(d) flowing well fluid into the separating section and separating the well fluid in the separating section into heavier and lighter components; then (e) flowing the heavier components through the liquid passage and to the pump; and (f) flowing the lighter components into the gas passage and out a gas outlet port of the gas separator.

17. The method according to claim 16, wherein step (f) comprises imparting energy to the lighter components as a result of the rotation of the crossover.

18. The method according to claim 16, wherein step (f) further comprising discharging the lighter components from the gas passage at an exit angle less than a 90 degree angle defined by a radial line emanating from a longitudinal axis of the gas separator and passing through an outlet of the gas passage.

19. The method according to claim 16, wherein step (e) comprises discharging the heavier components at a point that is closer to a longitudinal axis of the gas separator than an inlet of the liquid passage.

* * * * *

UNITED STATES PATENT AND TRADEMARK OFFICE

CERTIFICATE OF CORRECTION

PATENT NO. : 7,377,313 B2
APPLICATION NO. : 11/099734
DATED : May 27, 2008
INVENTOR(S) : Donn J. Brown et al.

It is certified that error appears in the above-identified patent and that said Letters Patent is hereby corrected as shown below:

Column 1, line 35, delete “direct” and insert --directed--

Column 5, line 32, delete “cross” and insert --crossover--

Signed and Sealed this

Twenty-third Day of September, 2008

JON W. DUDAS
*Director of the United States Patent and Trademark Office*